US005857228A

United States Patent [19]

Waltenberger et al.

[11] Patent Number: 5,857,228

[45] Date of Patent: Jan. 12, 1999

[54] TOILET FOR PUBLIC USE

[75] Inventors: Gerhard Waltenberger; Horst Wache, both of Berlin, Germany

[73] Assignee: Berliner Stadtreinigungsbetriebe, Berlin, Germany

[21] Appl. No.: 857,982

[22] Filed: May 16, 1997

[51] Int. Cl.[6] ..... A47K 4/00

[52] U.S. Cl. ..... 4/662; 4/664; 4/222

[58] Field of Search ..... 4/662, 663, 664, 4/222

[56] References Cited

U.S. PATENT DOCUMENTS

| | | | |
|---|---|---|---|
| 4,944,052 | 7/1990 | Wall | 4/662 |
| 5,279,008 | 1/1994 | Ritter | 4/662 |

FOREIGN PATENT DOCUMENTS

| | | | |
|---|---|---|---|
| 274785 | 7/1988 | European Pat. Off. | 4/662 |
| 4006676 | 9/1991 | Germany | 4/662 |
| 4221508 | 1/1994 | Germany | 4/662 |

*Primary Examiner*—David J. Walczak
*Assistant Examiner*—Kathleen J. Prunner
*Attorney, Agent, or Firm*—Cesari and McKenna, LLP

[57] ABSTRACT

A toilet block for public purposes comprises a toilet area and a washroom having a common floor and being accessible through a door. The toilet area comprises a toilet unit and the washroom has a wash basin and associated devices. A technical room, separated from the toilet area and washroom, contains equipment for supply, waste disposal and cleaning. The equipment includes apparatus, provided on an upper side of the floor of the toilet area and washroom, for wetting a surface of the floor with cleaning and/or disinfectant fluid and for evaporating the fluid.

16 Claims, 6 Drawing Sheets

TOILET FOR PUBLIC USE

The invention relates to a toilet block for public purposes, consisting of a toilet and washroom, accessible through a door, with a toilet unit or "water closet" (hereafter "WC") and a wash basin, and a technical room separated from the toilet and washroom, in which the equipment necessary for the supply, waste disposal and cleaning the toilet and washroom are contained.

A particular problem with such public toilet blocks lies in keeping the toilet block and the equipment contained therein clean with the lowest possible technical, labour and cost expenditure. In the toilet and washroom facilities used by many people it is desirable that after each use a cleaning and/or disinfection of the entire block is performed. Such a cleaning and/or disinfection of the entire block including the floor is in fact already possible with known toilet blocks, but this could previously be achieved only with relatively great expenditure.

Thus from German Offenlegungsschrift 4006676 a toilet block of the above-mentioned type is known, which is equipped with three technical rooms, two of which are located to the side of the toilet and washroom and one beneath the toilet and washroom. The toilet and washroom and a technical room disposed to the side thereof are preferably separated from one another by a wall, which is rotatable by 180° around a swivel axis, and at each side supports a toilet bowl. The floor of the toilet and washroom consists of a moving belt which is tensioned over rollers, which are disposed directly beneath the walls separating the lateral technical rooms from the toilet and washroom. Between the rollers is mounted a moving belt base, which supports the moving belt so that it can be walked upon. For cleaning the toilet block after use, firstly the side walls are rinsed by means of rinsing heads disposed thereon. Immediately afterwards the moving base is set in motion in the direction of the technical room, with at the same time the cleaning nozzles and drying elements disposed in the lower technical room being set in operation, which clean and dry the moving base now moving through the lower technical room. After switching on the moving belt, the partition between the toilet and washroom and technical room with the two toilet bowls fixed therein rotates around 180° and at the same time with lower scrapers scrapes all waste situated on the moving belt off it. Then the cleaning of the toilet bowl and the corresponding wall occurs in the technical room. In addition with this toilet block a safety device is necessary to start up the cleaning operation only when the floor has a loading of less than 15 kg so as not to endanger any persons, in particular small children, situated on the floor.

This cleaning system has the disadvantage that for cleaning the floor relatively expensive mechanical equipment with many moved parts is required, which is subject to high incidence of faults and in addition require expensive seals between the walls and the moved floor, which considerably increases the labour and cost-related expenditure of the production of the toilet block and its maintenance. In the event that the control mechanism provided to control the cleaning operation and/or the additional safety device do not operate correctly and the cleaning operation is set in motion although a person is still situated in the toilet and washroom, there is a great risk of injury by the sudden movement of the base under the feet of the user. Objects remaining lying on the base may also become jammed between the moving floor and the strippers, so that the base can no longer be transported in the desired manner for cleaning, or however objects unintentionally left lying by the users are transported through the system as waste into the lower technical room and are permanently lost to the users. The susceptibility of the moving belt itself by virtue of the mechanically moved parts has already been mentioned.

From German Offenlegungsschrift 4221508 a toilet block of the above-mentioned type is known, in which the automatic cleaning of the toilet block occurs by a rotation of a structural unit consisting of floor element, toilet bowl, seating surface and back part around a vertical axis integrated into the wall, whereby the parts used in each case are cleaned by means of high-pressure spray cleaning in a cleaning zone provided in the technical room and are subject to a drying process in a drying zone. Similarly as with the above-mentioned solution, here too a complicated, troublesome mechanism, which requires additional sealing devices, with movable parts is required to produce the correct cleaning of the toilet block after each use. Here too there is a considerable risk of injury in the event of the defective operation of the control appliance for the cleaning programme, as with this solution too the floor is suddenly moved under the feet of a user and can cause the person in the toilet and washroom to fall, with a considerable risk of injury, especially to the head region.

From EP-A-0274785 a public toilet installation of the above-mentioned type is known, in which in the partition between the toilet and washroom and the technical room cleaning nozzles are disposed just above the base, from which cleaning fluid is sprayed onto the cubicle floor. For cleaning the toilet bowl, cleaning nozzles are also disposed above it, which after the use of the toilet bowl spray cleaning fluid onto the edge of the toilet bowl. With this cleaning system the disadvantage lies in that the nozzles in fact reach the immediate region of the floor close to the toilet bowl with the cleaning fluid, but regions lying further away are not adequately wetted and cleaned. Moreover the fluid has to be atomised at high pressure in order to achieve at least a approximate distribution of the cleaning fluid over the floor of the toilet and washroom. Here too the cleaning of the toilet bowl itself may be performed only inadequately and the cleaning fluid sprayed in an uncontrolled manner from the edge of the toilet bowl through the cubicle. A further problem is the disposal of the cleaning fluid and the drying of the floor and the walls. The electrical heating elements provided in the base of the toilet and washroom represent a conventional floor heating system and serve to regulate the temperature of the interior of the toilet block during the cold season.

From EP-B-301070 a toilet block of the above-mentioned type is known, in which the base can be moved for cleaning into the laterally located technical room or can be rotated around a horizontal axis into a lower technical room. The above-mentioned disadvantages of a moved base are also inherent in this embodiment.

EP-A-685606 finally discloses a toilet block of the above-mentioned type, in which the base of the toilet and washroom and the toilet bowls are constructed as elements which can be swivelled into the technical room for the purpose of cleaning. With this toilet block the technical room is disposed underneath the toilet and washroom and the base and also the toilet bowl are swivelled after use into this technical room for cleaning. This cleaning process also requires expensive and complicated equipment for performing the cleaning, in which the same above-mentioned disadvantages are inherent.

Whereas the cleaning and disinfection of the toilet bowl itself is in the meantime achieved relatively well by it being rotated or swivelled for cleaning into a separate technical room, the cleaning of the floor by simple technical means is a constant problem.

The object of the present invention is therefore to construct a toilet block of the above-mentioned type in such a manner that a rapid and effective cleaning and/or disinfection of the toilet block including its floor is achieved with simple, low-maintenance means whilst essentially avoiding the above-mentioned disadvantages.

The object is achieved in accordance with the invention by a toilet block for public purposes, consisting of a toilet and washroom, accessible through a door, with a WC and a wash basin and also associated devices and a technical room separated from the toilet and washroom, which contains the equipment required for the supply, disposal and cleaning of the toilet and washroom, characterised in that the floor of the toilet and washroom is provided on its upper side with equipment for wetting the floor surface with cleaning and/or disinfectant fluid and for evaporating the same.

By the installation of the cleaning installation into the base itself, a movement of the floor for its cleaning/disinfection is no longer necessary, so that the toilet block of the conventional type can be constructed without additional mechanical apparatus to move the floor and the sealing means between the floor and side walls of the block. Thus both the manufacturing costs of the toilet block and also the costs of the continuous attendance and maintenance are reduced, since the number of components to be checked and maintained is substantially reduced. The susceptibility of the cleaning system to faults and breakdowns is substantially reduced by the fact that, apart from the WC, no movable parts are provided in the toilet block. The spray heads are cleaned by the constantly repeating passage of fluid and by the pressure surge itself, so that no cleaning/maintenance is necessary or and there is no danger of clogging.

In the event of a defective control system of the cleaning system, the probability of injury to a person using the toilet block is also substantially reduced, since the previously possible moving away of the floor underneath the user or the sudden movement of the moving belt of the base are avoided. The cleaning period can also be substantially reduced, since the time for the movement of the floor into the cleaning position is dispensed with. The electrical heating system evaporates the atomised fluid immediately, so that the toilet block is again available for use in a very short time. Cleaning and disinfection occurs with great efficiency and thoroughness, so that the toilet block is found by each user in the condition complying with hygiene requirements.

Advantageous embodiments of the invention are set forth hereinbelow.

A preferred embodiment of the invention is described below with reference to the drawings.

Figure 1:
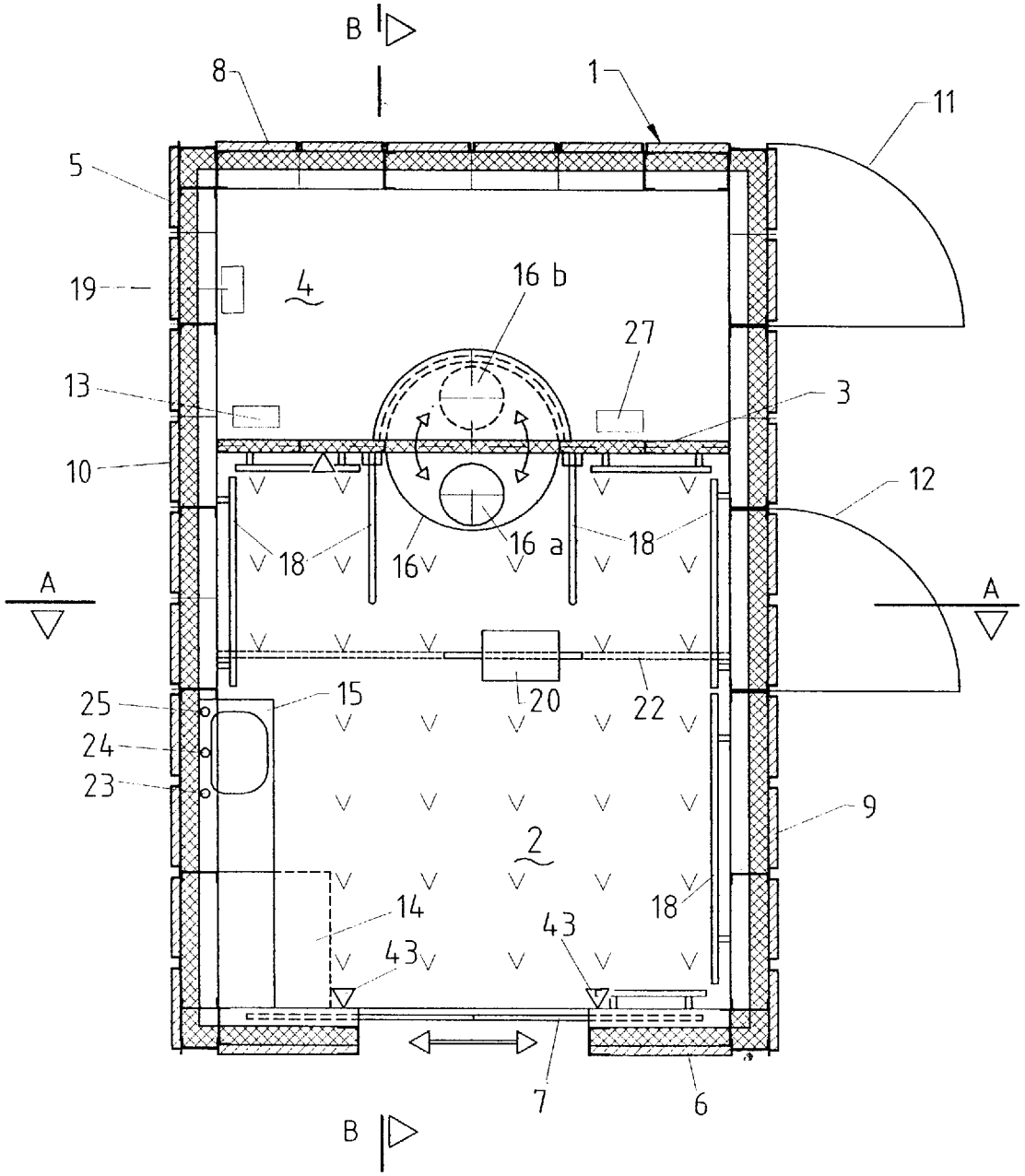
FIG. 1 shows the toilet block according to the invention in plan view without cover.
Figure 2:
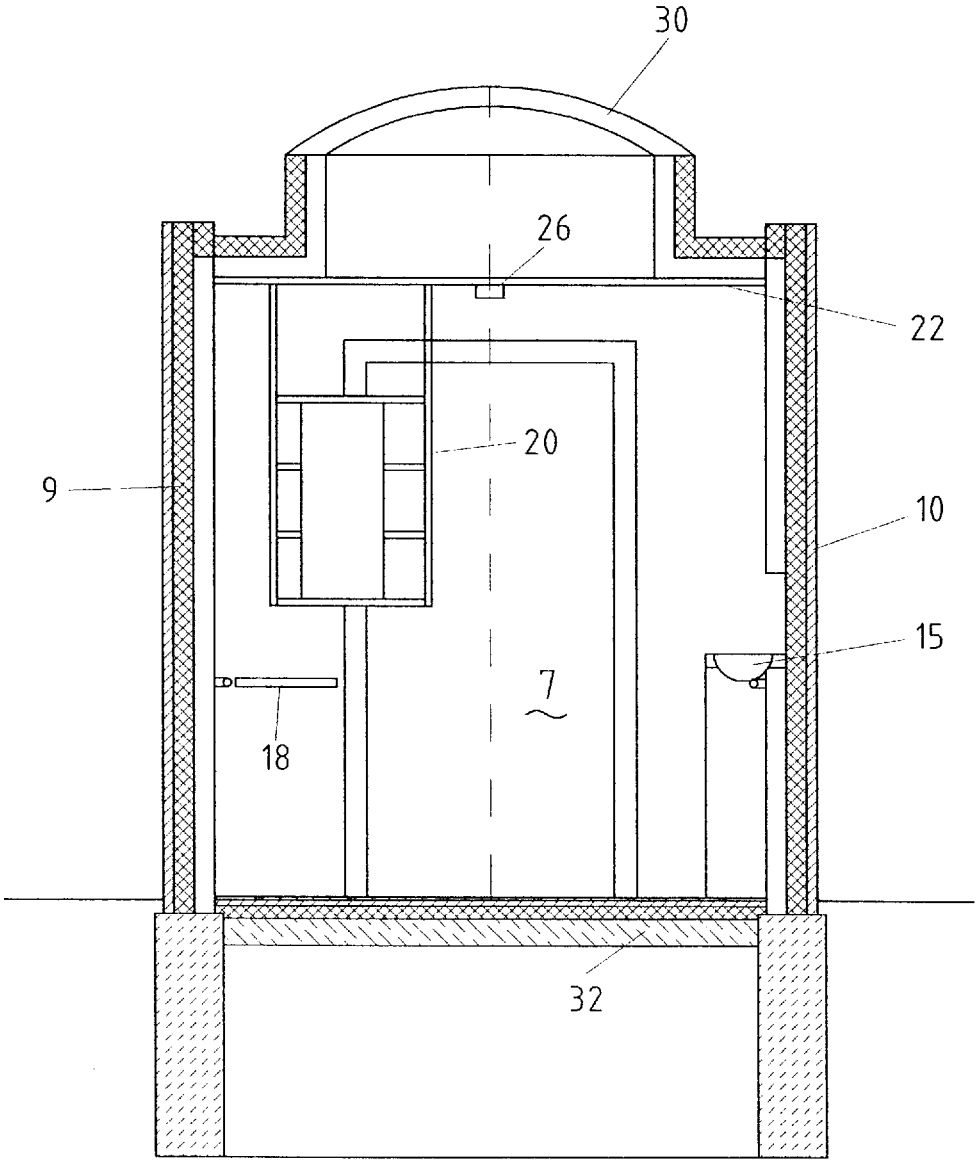
FIG. 2 shows the sectional view A—A.
Figure 3:
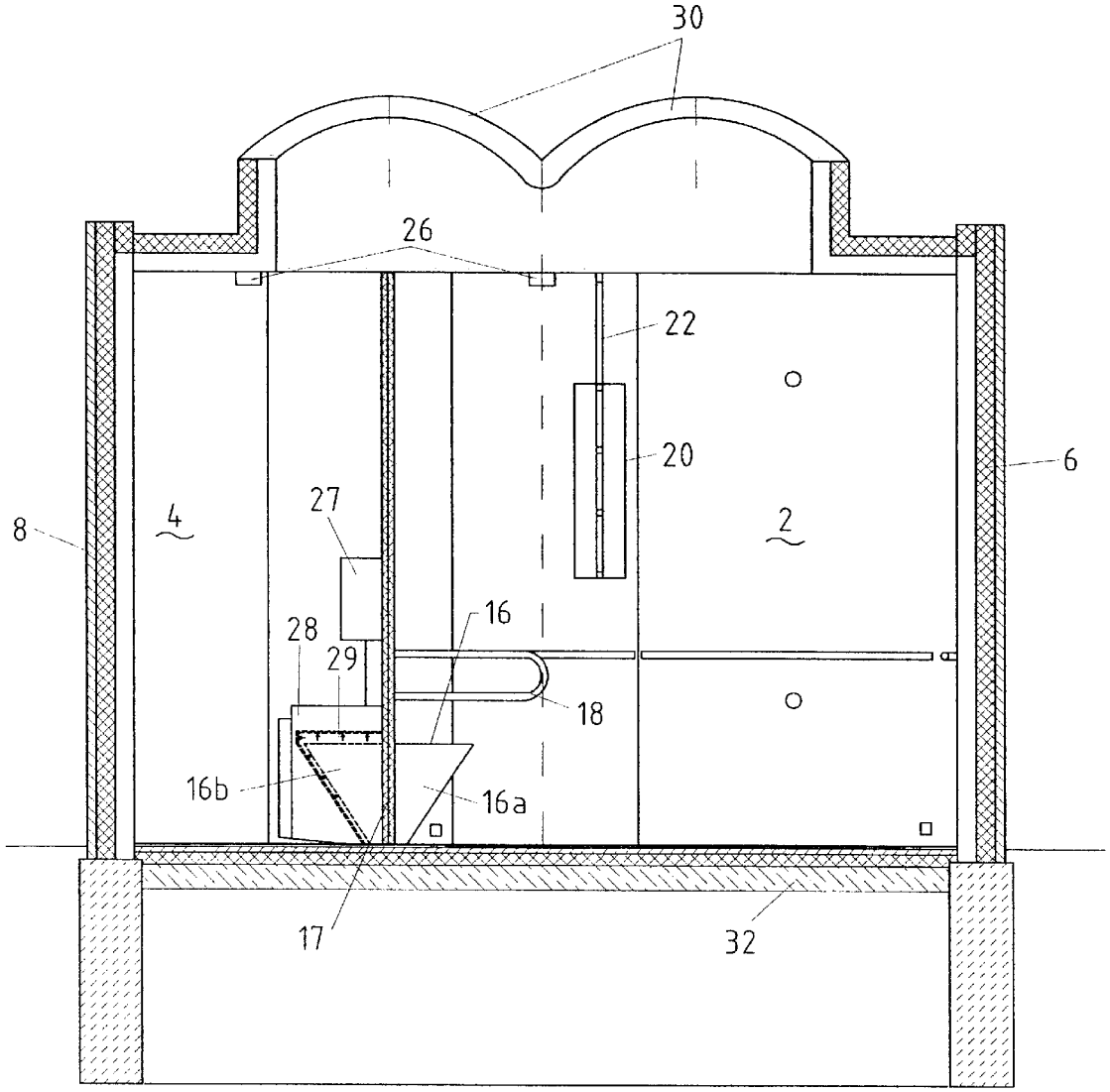
FIG. 3 shows the sectional view B—B.

As shown in FIGS. 1 to 3, a toilet block 1 for public purposes consists of a toilet and washroom 2 and a technical room 4 separated therefrom by a wall 3. At the front side 6 of the toilet block 1 an automatic door 7 is located, which can be operated by inserting a coin into a coin slot 21*a* provided on the front side 6 of the toilet block 1 (see FIG. 6). The door 7 is preferably constructed as an automatically shutting sliding door with a door leaf and jambs made from special steel. The opening and closing operation may preferably be supervised and controlled by a control device 13 so that the door 7 cannot be opened from outside when a user is located in the toilet and washroom 2 and so that the door 7 automatically closes again when the user has left the toilet and washroom 2 for the performance of the cleaning operation in the toilet and washroom 2 of the toilet block 1. The door 7 can only be opened again when the cleaning operation in the toilet and washroom 2 is over.

The technical room 4 for the service personnel is accessible through a separate door 11, which is closed for public access. Moreover an additional door 12 is provided in the side wall 9 of the toilet block 1 for emergencies. The toilet and washroom 2 contains a chest 14, which may be constructed as a baby-changing unit, a wash basin 15 with shelf, which is provided with a cleaning and disinfection system 19, and a WC 16 consisting of two toilet bowls 16*a*, 16*b*.

A dispenser 23 for warm soapy water, a dispenser 24 for clear warm water and also a hand drier 25, which are controlled in a known manner by contact-free electronics, are disposed above the wash basin 15. The wash unit is preferably made from stainless steel.

The WC 16 is rotatably mounted so that after each use it can be rotated by 180° through a corresponding opening in the wall 3 between the toilet and washroom 2 and the technical room 4 for cleaning. The rotation is preferably performed by means of a drive with radar control indicated at 43. The toilet bowls 16*a*, 16*b* rotate around a vertical axis 17 lying centrally between the two toilet bowls 16*a*, 16*b*, so that in each case one of the toilet bowls 16*a*, 16*b* is available for use in the toilet and washroom 2, while the other toilet bowl is situated in technical room 4 for cleaning. A corresponding opening is provided in the partition 3. By the truncated-conical design of the toilet bowls 16*a* and 16*b*, which can be seen in FIG. 3, the opening in the partition 3, through which the rotation of the toilet bowls 16*a*, 16 occurs, can be produced simply and with a good sealing action. In principle it would also be possible to provide the entire partition 3 including the WC 16 or the corresponding wall part including the WC 16 as a rotatable unit. Handles or handlebars 18 are provided on the side walls 9, 10 of the toilet and washroom 2 and also on both sides of the WC 16 to enable and to facilitate the use of the toilet by wheelchair users and physically handicapped persons.

In the vicinity of the WC 16 a guide rail 22 is disposed in the transverse direction through the toilet and washroom 2, on which a box or a container 20 can be moved backwards and forwards preferably by means of rollers between the two side walls 9, 10 of the toilet block 1. This container 20 possesses in each case a dispenser for toilet seat covers and toilet paper and also an emergency button for danger. Accessibility from all sides is guaranteed by the mobility of the container 20, which is of particular importance for physically handicapped persons.

The technical room 4, which is situated in the rear part of the toilet block 1, limited by the rear wall 8 and separated from the toilet and washroom 2 by the partition 3, is equipped with the equipment necessary for the operation of the toilet block 1. This includes in particular monitoring, control and regulating elements 13 to guarantee the smooth, automatic operating sequence and also the equipment required for the supply, disposal and cleaning of the toilet and washroom 2. These are generally known in accordance with the prior art and are therefore not described in further detail and are not represented in the drawings for the sake of clarity.

An automatic cleaning and disinfection unit 28 for the cleaning and disinfection of the toilet bowls 16*a*, 16*b* is also provided in the technical room 4. As diagrammatically represented in FIG. 3, this cleaning and disinfection unit 28 surrounds the toilet bowl 16*a* or 16*b* to be cleaned and cleans it by a jetting device 29 from inside and outside. Then it is dried by a warm air spray 27.

For the sake of completeness it is mentioned that the toilet block 1 is also equipped in the known manner with fans for the toilet and washroom 2 and the technical room 4 and also lighting, emergency lighting, an indicator light for leaving the toilet after a predetermined time, a hands-free telephone for the fire alarm installation to the service centre or the fire brigade and for the emergency alarm to the service centre, the police and/or fire brigade, which are however not represented in the drawings. A smoke and fire detector 26 is also provided.

The toilet block 1 is manufactured from structurally supporting wall elements 5 in a sandwich design, which permit a variable facade design as specified by the desired architecture, such as for example natural stone, wall concrete, wood or masonry. The inner facing of the toilet block 1 is preferably made of profiled special steel plate. The roof elements are also produced in structurally supporting sandwich design, with a double-shell dome light 30 having fans installed in the base (not represented) preferably being constructed.

Figure 5:
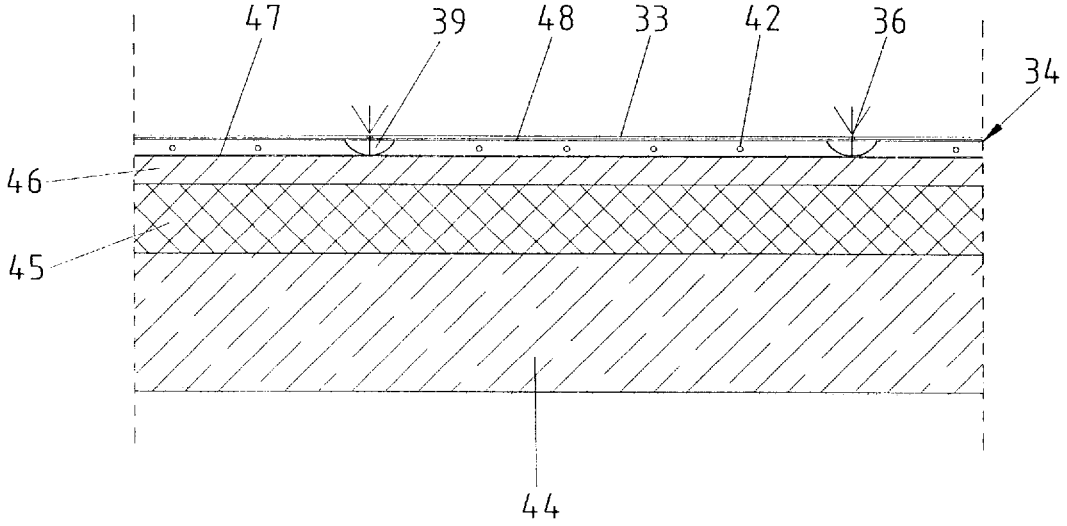
FIG. 5 shows a floor element as specified by the invention with spray nozzle system and electrical heating system in section.

The floor 32 of the toilet block 1 is also produced in a structurally supporting sandwich design. As can be seen from FIG. 5, a structurally supporting double-walled floor element 34, which is formed from a lower sheet metal plate 47 and an upper sheet metal plate 48 with integrated spray heads or spray nozzles 36, is attached to the floor 32 consisting of load-bearing concrete 44, thermal insulation 45, levelling layer 46. The spray heads 36 are disposed at regular intervals similar to a grid and are connected via distribution channels 39 to a supply line 38 for the disinfectant or another cleaning fluid. The floor surface 33 may be a conventional floor covering, for example glued ceramic covering, in which the spray head openings of course have to be left open.

The supply line 38 is connected to a container, preferably a high-level tank (not represented), which contains the disinfectant or another cleaning fluid. As diagrammatically shown in FIG. 4, a valve 41 is provided downstream from the container in the supply line 38, which valve is opened for a short time for the cleaning/disinfecting operation, so that the fluid is sprayed at sufficient pressure from the spray heads 36 and the floor surface 33 to be disinfected is completely wetted. If the pressure in the supply line 38 and at the spray heads 36 is not sufficient to wet the floor surface 33 completely, a pressure device 40, for example a suitable pump, may additionally be provided in the supply line 38 in order to produce a temporary pressure surge at the spray heads 36, which effects the wetting of the floor surface 33 with the disinfectant or the cleaning fluid, as represented diagrammatically in FIG. 1 by the v-shaped symbols. The cleaning fluid or disinfectant should preferably be discharged at a pressure of roughly 3 to 5 atmospheric excess pressure. Simultaneously with the atomization of the disinfectant or the cleaning fluid or directly after its end, the heating elements 42 also integrated in the floor element 34 are also switched on at high power, so that the liquid applied to the floor surface 33 evaporates immediately. The heating elements 42 are preferably switched on only for evaporating the applied fluid and are operated for a short time, preferably approx. 1.5 to 2 minutes, at high power, preferably in a temperature range of roughly 45° to 60° C. Depending on the type of the cleaning agent or disinfectant used and its evaporating temperature, lower or higher temperatures may also be used. It is also obvious that the evaporation time is reduced at higher temperatures, so that time given above could, where appropriate, be shortened, or, if the most immediate possible use of the installation is not necessary, can also be exceeded when lower temperatures are used. The heating elements 42 may however of course be permanently in operation in the cold season, so as to serve simultaneously as room heating for the toilet and washroom 2 or as additional heating for the toilet and washroom 2, with it here too being preferably possible to switch the heating elements 42 to a high degree to guarantee the immediate evaporation operation.

Figure 4:
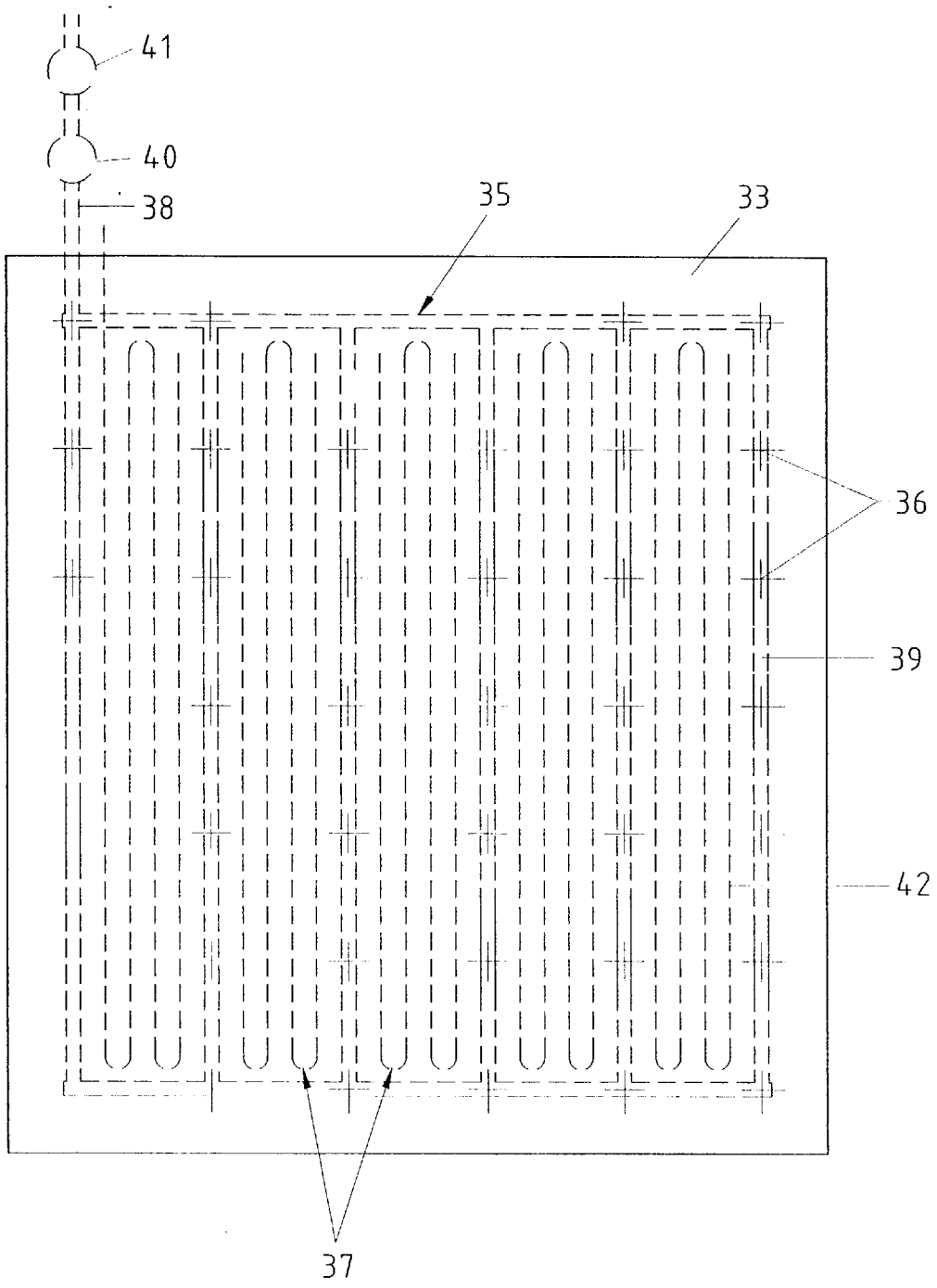
FIG. 4 shows a floor element with spray nozzle system and electric heating system in plan view.

As represented in FIG. 4, the heating elements 42 are preferably disposed in the form of electrical heating mats parallel to the distribution channels 39 between the spray heads 36. However any other suitable electrical heating elements may also be used, of course also in any different suitable arrangement e.g. serpentine-fashion around the spray heads 36.

Instead of a single floor element 34, the size of which corresponds roughly to the floor plan of the toilet and washroom 2 or is slightly smaller than it, several smaller, preferably rectangular, floor elements 34 may be used, which when combined cover the substantially entire floor.

The floor 32 can be provided over the spray nozzle 35 and heating 37 systems specified by the invention with a conventional floor covering, such as e.g. a glued ceramic covering, wherein of course the spray head openings may not be covered.

The entire automatic cleaning operation and also the other operating components of the toilet block 1 are controlled by a suitable control installation 13 known per se, which is known to the person skilled in the art and does not need to be explained in further detail here.

The toilet block 1 is expediently operated as a slot machine. Next to the entrance door 7 is provided a corresponding coin slot device 21, 21*a* with integrated coin tester and display device (see FIG. 6), which is automatically controlled by the control unit 13 in the technical room 4. After the insertion of an appropriate coin, the automatic entrance door 7 is released and automatically opened, so that the toilet and washroom 2 is available for use. After use the flushing of the WC 16 is triggered either by the user himself or, if this is forgotten, a forced flushing occurs after the vacation of the toilet and washroom 2. After the entrance door 7 has closed again, the cleaning operation is started. However this only occurs if the corresponding safety devices, such as e.g. light barriers or the like, announce a free toilet and washroom 2 to the control unit 13. The entrance door 7 is then locked and the announcement "cleaning operation" or the like appears on the display device 12 next to the entrance door 7.

After the vacant message of the toilet and washroom 2 and the locking of the entrance door 7, the WC is rotated by 180° and for the toilet bowl 16*a* or 16*b* located in the cleaning unit 28 in the technical room 4 the automatic cleaning operation for the interior and exterior cleaning of the toilet bowl 16*a* or 16*b* is triggered. Simultaneously with the rotation of the WC 16 or before it or a short time after the valve 41, or, if provided, the pressure device 40, is actuated in order to spray, by means of the pressure surge produced thereby, disinfectant or cleaning fluid out of the spray heads 36 onto the floor surface 33. Immediately after the end of the spraying operation or during said operation the electrical heating elements 42 are switched on and operated at such power that the previously atomised liquid evaporates on the floor surface 33 in a short time. During this the cleaning and disinfection system 19 for the wash basin 15 has also been switched on in order to clean and disinfect it at the same time. Since the cleaning and subsequent drying of the toilet bowls 16*a* and 16*b* can be performed while a further toilet bowl is available for use in the toilet and washroom 2, this cleaning and drying operation can take a longer time period without impeding the use of the toilet and washroom 2. The cleaning/disinfection of the floor 32 and of the wash basin 15 is completed in less than three minutes, so that then the locking of the entry door 7 can be released and the toilet and washroom 2 can be freed for the next use, even if the cleaning and drying of the toilet bowls 16*a* and 16*b* in the technical room 4 should not yet have been completed.

Figure 6:
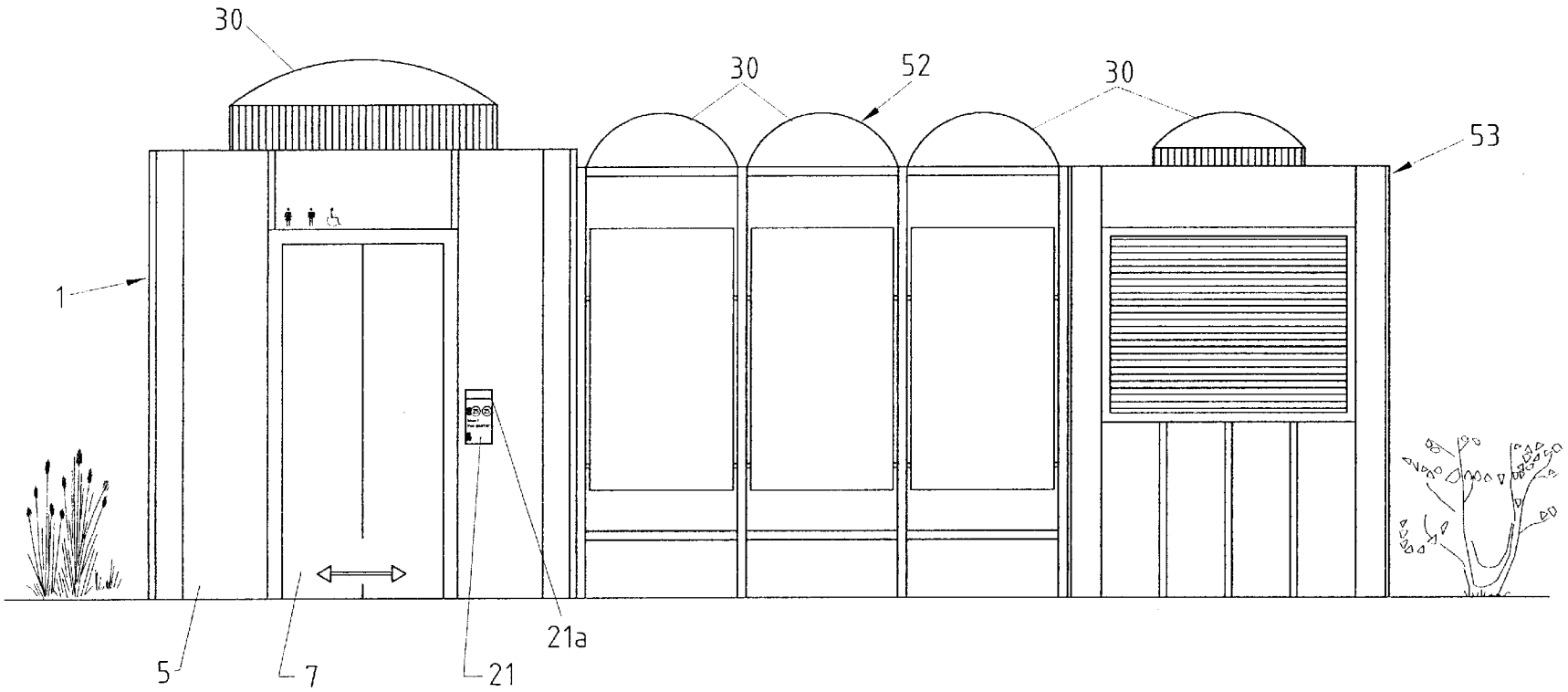
FIG. 6 shows the toilet block combined with a waiting room and newspaper kiosk.

By the problem-free combination represented in FIG. 6 of the toilet block according to the invention with further structures erected in a similar style, such as e.g. a waiting room 52 or a newspaper kiosk 53, a structure which can be adapted for various locational conditions and desires is provided.

The present toilet block has considerable advantages when compared with the conventional prior art. In particular only one technical room for the entire installation is required, so that considerable constructional expenditure for the technical rooms otherwise required beneath the toilet block is saved. Both a time-saving for the cleaning operation is achieved and also an almost maintenance-free and very reliable mode of operation of the toilet block is achieved by the elimination of all mechanically rotatable or swivelling parts in the floor cleaning and disinfection.

One container for the cleaning fluid and the disinfectant, which can be conveyed through respective supply lines to the spray heads 36, the spray heads at the wash basin 15 and also the spray heads of the WC cleaning unit 29, is sufficient in the technical room 4. No further technical or cleaning rooms or installations are necessary underneath the floor 32. The technical room 4 can be erected in a space-saving manner, so that the general requirement of the smallest possible spatial requirement for the erection of the toilet blocks is taken into consideration.

We claim:

1. A toilet block for public purposes, the toilet block comprising:

a. a toilet area and a washroom having a common floor and being accessible through a door, the toilet area comprising a toilet unit and the washroom comprising a wash basin and associated devices, b. a technical room separated from the toilet area and washroom, and c. supply, waste disposal and cleaning equipment for the toilet area and washroom, said equipment comprising means, provided on an upper side of the floor (32) of the toilet area and washroom (2), for wetting a surface (33) of the floor with cleaning and/or disinfectant fluid and for evaporating said fluid.

2. A toilet block according to claim 1, characterised in that the equipment comprises a spray nozzle system (35) disposed on the surface (33) of the floor (32) and connected to a cleaning fluid/disinfectant supply (38) and an electrical heating system (37).

3. A toilet block according to claim 2, characterised in that the spray nozzle system (35) and the heating system (37) are integrated together in a floor element (34).

4. A toilet block according to claim 3, characterised in that the floor element (34) is a structural supporting double-walled floor element having integrated spray heads (36), a supply line (38) for cleaning fluid/disinfectant and electrical heating elements (42) disposed between the spray heads (36).

5. A toilet block according to claim 4, characterised in that the supply line is connected to a container for the cleaning fluid and/or disinfectant and comprises a valve (41).

6. A toilet block according to claim 5, characterised in that the supply line (38) also comprises a pressure device (40).

7. A toilet block according to claim 1, characterised in that the toilet unit (16) comprises two toilet bowls (16*a*; 16*b*) rotatable around a vertical axis (17), one of said toilet bowls being situated in the technical room (4), while the other of said toilet bowls is available for use in the toilet area and wash room (2).

8. A toilet block according to claim 7, characterised in that the toilet unit (16) is automatically rotatable by 180° around a vertical axis (17), by a drive having radar control, after each use of the toilet and wash room (2) for cleaning by means of a high-pressure spray unit (29) provided in the technical room (4) and connected to a cleaning container, and for subsequent drying by means of a warm-air spray (27).

9. A method for cleaning the toilet area and wash room (2) according to claim 8, the method comprising the steps of:

a. rotating the toilet unit by 180° and cleaning the toilet bowl situated in the technical room, b. spraying the wash basin and the floor of the toilet area and washroom with the cleaning fluid and/or disinfectant, and c. heating the floor to evaporate fluid therefrom.

10. A toilet block according to claim 1, characterised in that an automatic cleaning and disinfection system (19) is provided for the wash basin (15).

11. A toilet block according to claim 1, further comprising at least one device (20, 22) disposed in the vicinity of the toilet unit (16) and movable above head height transversely through the toilet area and wash room (2), each said device comprising means for dispensing toilet seat covers and toilet paper and having an emergency button.

12. A toilet block according to claim 1, further comprising a dispenser for soapy water (23) and for rinsing water (24) and also a warm-air hand drier (25) disposed in the vicinity of the wash basin (15).

13. A toilet block according to claim 1, further comprising an automatic control device (13), located in the technical room (4), for controlling cleaning of the toilet block (2).

14. A toilet block according to claim 1, characterised in that the toilet block (2) comprises a plurality of wall elements (5) in a structurally supporting sandwich design.

15. A toilet block according to claim 14, wherein the toilet block (1) further comprises facilities assembled from essentially similar wall elements (5) to form an overall structural complex.

16. A toilet block according to claim 1, further comprising a waiting room (52) and/or a kiosk (53) combined with the toilet block to form an overall structural complex.

* * * * *